US006208314B1

(12) United States Patent
Bourquin

(10) Patent No.: US 6,208,314 B1
(45) Date of Patent: Mar. 27, 2001

(54) SATELLITE RECEPTION ANTENNA

(75) Inventor: Patrick Bourquin, Beaucourt (FR)

(73) Assignee: Tele-Equipement, Beaucourt (FR)

( * ) Notice: Subject to any disclaimer, the term of this patent is extended or adjusted under 35 U.S.C. 154(b) by 0 days.

(21) Appl. No.: 09/254,267

(22) PCT Filed: Aug. 19, 1997

(86) PCT No.: PCT/FR97/01505

§ 371 Date: Mar. 3, 1999

§ 102(e) Date: Mar. 3, 1999

(87) PCT Pub. No.: WO98/10486

PCT Pub. Date: Mar. 12, 1998

(30) Foreign Application Priority Data

Sep. 4, 1996 (FR) ..... 96-10945

(51) Int. Cl.[7] ..... H01Q 1/42
(52) U.S. Cl. ..... 343/872; 343/840; 343/704
(58) Field of Search ..... 343/872, 709, 343/704, 840; H01Q 1/42, 19/12

(56) References Cited

U.S. PATENT DOCUMENTS

| | | | | |
|---|---|---|---|---|
| 3,790,949 | | 2/1974 | McGraw | 343/719 |
| 3,815,140 | * | 6/1974 | Buehler et al. | 343/872 |
| 4,710,778 | * | 12/1987 | Radov | 343/872 |
| 4,920,350 | * | 4/1990 | McGuire et al. | 343/709 |
| 5,278,562 | * | 1/1994 | Martin et al. | 343/872 |
| 5,729,238 | * | 3/1998 | Walton, Jr. | 343/704 |
| 5,844,529 | * | 12/1998 | Bell et al. | 343/872 |

FOREIGN PATENT DOCUMENTS

| | | | | |
|---|---|---|---|---|
| 0 026 001 | | 4/1981 | (EP) . | |
| 2207814 | * | 2/1989 | (GB) | H01Q/1/42 |
| 2 211 609 | | 7/1989 | (GB) . | |
| WO 90/01223 | | 2/1990 | (GB) . | |
| WO 95/34101 | | 12/1995 | (GB) . | |
| 1-259602 | * | 10/1989 | (JP) | 343/872 |

* cited by examiner

*Primary Examiner*—Hoanganh Le
(74) *Attorney, Agent, or Firm*—Nilles & Nilles SC

(57) ABSTRACT

A reception antenna, applicable to the field of television signal transmission, for picking up signals originating from a stationary satellite which has a paraboloid reflector capable of reflecting signals received and concentrating them in a focal point where a source is arranged for guiding the signals towards a frequency converter. The source and the reflector are located inside a polyhedral housing permeable to electromagnetic waves and its lower surface is designed to be placed horizontally when the receiving antenna is being used, the relative positioning of the source and the reflector with respect to the housing lower surface has a predetermined on-site adjustment originally built in. The relative positioning takes into account the elevation angle corresponding to the position of the targeted satellite.

9 Claims, 1 Drawing Sheet

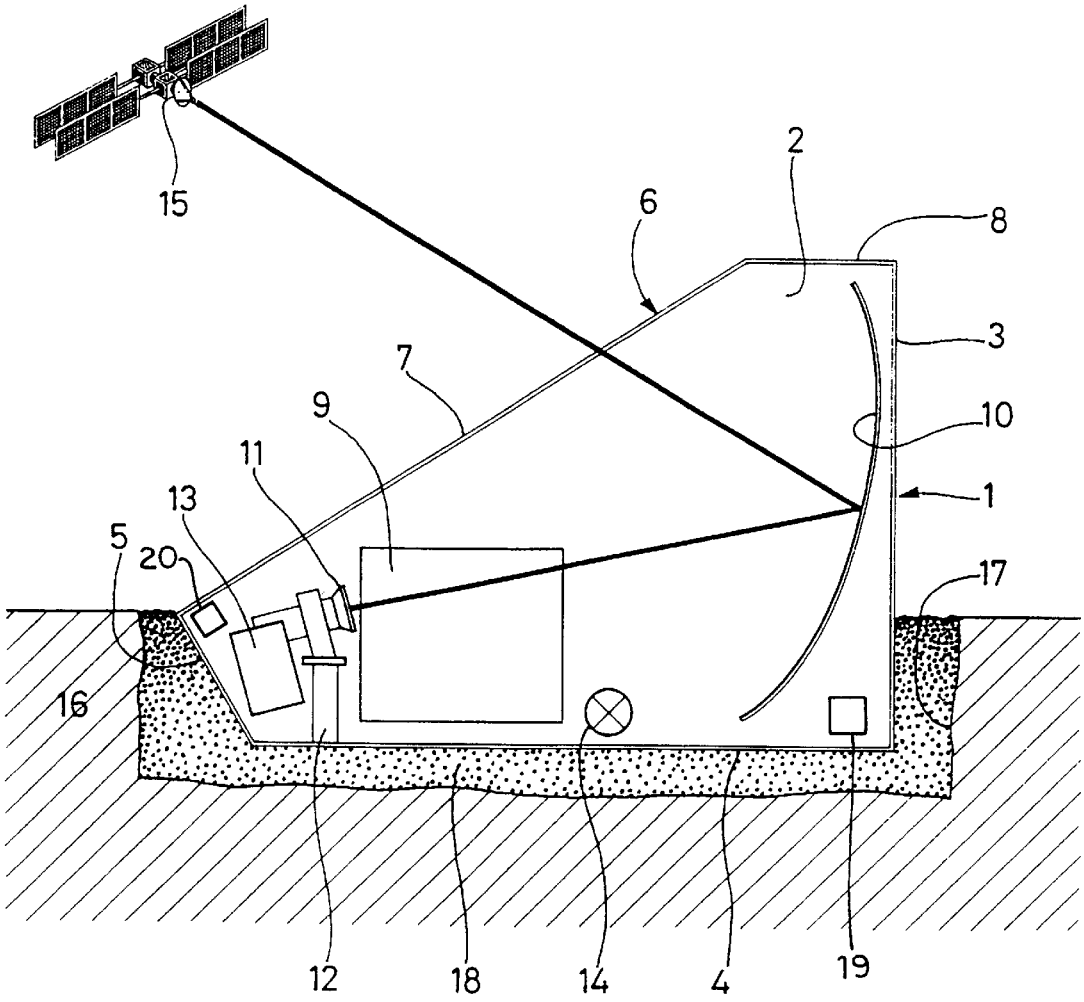
15
2
6
8
3
7
9
10
11
1
13
5
20
17
16
12
18
14
4
19

SATELLITE RECEPTION ANTENNA

BACKGROUND OF THE INVENTION

1. Field of the Invention

The present invention relates to a reception antenna intended for picking up signals from a geostationary satellite.

The invention finds an especially advantageous application in the field of the transmission of television signals, be they intended for individual or communal use.

Developments in digital technology have spurred a veritable revolution in the audiovisual sector. Apart from unequaled restitution of picture and sound, digital satellite broadcasting affords genuine interactivity as well as very great flexibility of use so as to be able to accommodate everybody's taste and pace of life.

2. Description of the Related Art

Additionally, an increasingly large number of geostationary satellites are operational for broadcasting ever more numerous and diversified programs. With these comes a generalization towards broadcasting systems using several co-positioned satellites, that is to say which transmit from a single point in the sky. This is in particular the case with the system developed by ASTRA which, like its counterparts, has the advantage of requiring only very simple reception hardware to access a very large number of existing or future programs, namely a single fixed directional antenna.

Schematically, the latter is composed of a reflector, a source and a frequency converter. To make it sufficiently directional, the reflector has the shape of a paraboloid or a portion of a paraboloid. The signals received from the satellite are thus reflected and concentrated at a focal point. The source, an accessory intended for guiding the waves towards the converter which modifies their frequency, is positioned at precisely this location.

The reception antennas used are essentially of the offset type by virtue of their great compactness. On account of its off-centering, the source of this family of parabolas does not in fact cast any shadow on the surface which reflects the signal, thereby affording better gain and consequently making it possible to reduce the dimensions of the antenna.

However, the growing success of this digital technology within the mass market is manifested by a proliferation of parabolic antennas on the facades or roofs of individual houses or communal premises. From around 50 to 80 cm in diameter, they are often deemed to be especially unesthetic and sometimes too bulky when room is tight, as on a window ledge for example.

Moreover, their installation requires the use of a specific support structure and, of course, certain more or less complex adjustment operations so as to accurately position the parabola in the horizontal and vertical planes, as a function of the azimuth and elevation of the targeted satellite.

On account of their design, these reception antennas are also directly exposed to the natural elements such as the sun, the wind, moisture or snow, all factors which are prejudicial to their proper operation.

Additionally, the technical problem to be solved by the subject of the present invention is to propose a reception antenna intended for picking up signals from a geostationary satellite, comprising in particular a paraboloid-shaped reflector able to reflect the signals received and to concentrate them at a focal point whereat is arranged a source able to guide said signals towards a frequency converter, which reception antenna would make it possible to avoid the problems of the prior art while being almost insensitive to meteorological conditions and very easy to install, and yet offering a more discreet appearance.

OBJECTS AND SUMMARY OF THE INVENTION

The solution to the technical problem posed consists, according to the present invention, in the source as well as the reflector being arranged inside a polyhedral casing, which is permeable to electromagnetic waves and whose lower face is intended to be placed horizontally when using the reception antenna, the relative positioning of said source and of said reflector with respect to said lower face of the casing incorporating at the outset a specified elevational adjustment, that is to say said relative positioning takes into account the angle of elevation corresponding to the position of the targeted satellite.

The invention as defined has the advantage of being excessively easy to set up since, by laying the casing level on a horizontal surface, it is possible to do away with the adjustment in elevation. It is then sufficient simply to orient said casing in the azimuthal direction of the satellite so as to be able to capture the transmitted waves perfectly.

In contrast to the prior art devices, the polyhedral casing is esthetically entirely inoffensive thereby enabling it to blend easily into the urban landscape. This ability may be further accentuated through the fact that it is possible to paint it, in a color identical or similar to its direct environment. Furthermore, it offers effective protection against U.V. from the sun or moisture, smaller wind resistance and the possibility of operating perfectly even when covered with snow.

According to a particular feature of the invention, the frequency converter is also mounted inside the polyhedral casing. Thus, in practice, the source and the converter are coupled directly together so as to form just one single component whose compactness gives rise to greater ease of use.

The following description in conjunction with the appended drawings, given by way of non-limiting examples, will elucidate the gist of the invention and the manner in which it may be embodied.

BRIEF DESCRIPTION OF THE DRAWING

The single FIGURE represents a longitudinal sectional view through a reception antenna according to a particular embodiment of the invention.

DESCRIPTION OF THE PREFERRED EMBODIMENTS

For reasons of clarity, only the elements which are essential to an understanding of the invention have been represented, doing so in a schematic manner which is not to scale.

The casing 1 illustrated in the FIGURE is heptahedral. The two side walls 2 parallel to the sectional plane are of identical shapes. Just like the rear wall 3, they are positioned orthogonally to the lower face 4, whilst the front face 5 is inclined outward. The upper face 6 is here split into two parts of which the main part 7, through which the majority of the electromagnetic waves is intended to pass, is not parallel to the lower face 4; this is so as to preclude the depositing of any object whose presence could disturb reception, and parenthetically to allow a satisfactory flow of water or melted snow.

Advantageously, one of the side walls 2 is provided with a trap door 9 making it possible to access the inside of the casing 1; this occludable aperture being intended to allow maintenance of the various internal components of the reception antenna.

A reflector 10 is placed with its back to the rear wall 3, under a secondary part 8 of the upper face 6. So as best to fit within the internal space available, the contour of this portion of paraboloid here matches substantially the shape and the dimensions of this location of the casing 1, that is to say it has the shape of a right-angled parallelogram. Of course, the reflector 10 can consist of a metallized concave element of any nature, such as for example a molded plastic covered with copper or with chromium; or may quite simply be metallic, such as an aluminum mirror.

The source 11 is for its part clipped onto a support 12 positioned facing the reflector 10. It is coupled directly to the converter 13 for the reasons of convenience already mentioned. Its orientation in the vertical plane, just like the position of the reflector with respect to the lower face 4, is determined as a function of the elevation of the targeted satellite 15, that is to say of the angle measured in a vertical plane between the horizon and said satellite 15. As this inclination varies according to the latitude of the place of aim, the angle of elevation taken into account is an average of the values charted within the area covered by the broadcasting of the signal. To guarantee optimal quality of reception in the case of extremely wide coverage, it is however possible to provide for minor variations in this value of the elevation for one and the same region; the relevant space being divided into several areas, each of which is allocated a specific angle of elevation.

In an especially advantageous manner, the casing 1 is mounted in a perfectly sealed manner and may possibly enclose means for capturing any trace of moisture 19, such as for example bags of silica. Likewise, it may be equipped with a heating system 20 making it possible if necessary to melt any snow, essentially on its upper face 6.

As may be seen in the FIGURE, the reception antenna is provided with an internal lighting system 14 which, combined with the translucent nature of the material constituting the main part 7 of the upper face 6, offers a two-fold advantage. On the one hand, when turned on it affords undeniable decorative appeal, and on the other hand it can form a source of heat of a nature such as to engender the same effects as an internal heating system. The translucent face used in this configuration may be made from Plexiglas or Altuglas, materials which are moreover permeable to electromagnetic waves.

In this particular embodiment of the invention, the other faces of the casing 1 are made from expanded PVC, that is to say from a strong material, also permeable to waves and which furthermore offers very good durability, even when exposed to a variety of bad weather. A cellular PVC may possibly be used so as to further increase its strength, in relation to hailstones for example.

In practice, the reception antenna in accordance with the invention can be used in a conventional manner, that is to say fixed on a vertical support. However it can also, in an especially advantageous manner, be laid directly on the ground 16 or be partly buried. In the first case, care will be taken to obtain a perfectly horizontal surface. In the second, it will be sufficient to dig in the ground 16 a hole 17 of a volume substantially equal to the dimensions of the casing 1 and oriented substantially along the azimuthal direction of the targeted satellite 15, to deposit a bed of sand 18 in the bottom and then to position said casing 1 horizontally with the aid of a level, this time accurately checking said azimuthal direction with a compass.

What is claimed is:

1. A reception antenna intended for picking up signals from a geostationary satellite (15), comprising a paraboloid-shaped reflector (10) able to reflect the signals received and to concentrate them at a focal point whereat is arranged a source (11) able to guide said signals towards a frequency converter (13), wherein the source (11) and the reflector (10) are arranged inside a polyhedral casing (1), which is permeable to electromagnetic waves and whose lower face (4) is intended to be placed horizontally when using the reception antenna, the relative positioning of said source (11) and of said reflector (10) with respect to said lower face (4) of the casing (1) incorporating the angle of elevation corresponding to the position of the geostationary satellite (15) wherein at least part of the upper face (6) of the casing (1) lies in a plane secant to the plane passing through the lower face (4) of said casing (1).

2. The reception antenna as claimed in claim 1, wherein the frequency converter (13) is arranged inside the polyhedral casing (1).

3. The reception antenna as claimed in claim 1, wherein the casing (1) comprises an occludable aperture (9) allowing maintenance of the various components present inside.

4. The reception antenna as claimed in claim 1, wherein the casing (1) is completely sealed.

5. The reception antenna as claimed in claim 1, wherein the casing (1) encloses means for capturing moisture.

6. The reception antenna as claimed in claim 1, wherein the casing (1) comprises heating means able to allow snow to be cleared from its upper face (6).

7. The reception antenna as claimed in claim 1, wherein the casing (1) is made at least in part of polyvinyl chloride.

8. The reception antenna as claimed in claim 1, wherein the casing (1) encloses an internal lighting system (14) and wherein at least one part (7) of the upper face (6) of said casing (1) is made with a translucent material which is permeable to electromagnetic waves.

9. A process for installing a reception antenna intended for picking up signals from a geostationary satellite, comprising a paraboloid-shaped reflector able to reflect the signals received and to concentrate them at a focal point whereat is arranged a source able to guide said signals towards a frequency converter, wherein the source and the reflector are arranged inside a polyhedral casing, which is permeable to electromagnetic waves and whose lower face is intended to be placed horizontally when using the reception antenna, the relative positioning of said source and of said reflector with respect to said lower face of the casing incorporating the angle of elevation corresponding to the position of the geostationary satellite wherein at least part of the upper face of the casing lies in a plane secant to the plane passing through the lower face of said casing, and wherein said process comprises the operations consisting in:

digging in the ground (16) a hole (17) of a volume substantially equal to the dimensions of the casing (1), said hole (17) being oriented substantially along the azimuthal direction of the targeted satellite (15), depositing a bed of sand (18) in the bottom of the hole (17), positioning the casing (1) horizontally on the bed of sand (18), this time accurately checking the azimuthal direction with a compass.

* * * * *